US011098420B2

(12) United States Patent
Corbellini et al.

(10) Patent No.: US 11,098,420 B2
(45) Date of Patent: Aug. 24, 2021

(54) METHOD FOR PRODUCING A TEXTILE PRODUCT

(71) Applicant: NV MICHEL VAN DE WIELE, Kortrijk/Marke (BE)

(72) Inventors: Ermete Corbellini, Cosio Valtellino (IT); Steven Debaes, Rekkem (BE); Claudio Fiorina, Sondrio (IT)

(73) Assignee: NV MICHEL VAN DE WIELE

( * ) Notice: Subject to any disclaimer, the term of this patent is extended or adjusted under 35 U.S.C. 154(b) by 198 days.

(21) Appl. No.: 16/070,522

(22) PCT Filed: Jan. 13, 2017

(86) PCT No.: PCT/IB2017/050183

§ 371 (c)(1),
(2) Date: Jul. 16, 2018

(87) PCT Pub. No.: WO2017/122164

PCT Pub. Date: Jul. 20, 2017

(65) Prior Publication Data

US 2019/0024272 A1 Jan. 24, 2019

(30) Foreign Application Priority Data

Jan. 15, 2016 (BE) ..... BE2016/0010

(51) Int. Cl.
*D01D 5/08* (2006.01)
*D01D 5/22* (2006.01)
(Continued)

(52) U.S. Cl.
CPC ..... *D03D 15/567* (2021.01); *D02G 1/004* (2013.01); *D02G 3/445* (2013.01); *D03D 27/00* (2013.01);
(Continued)

(58) Field of Classification Search
CPC .. D01D 5/08; D01D 5/22; D01D 7/00; D01D 10/02; D01F 6/06; D01F 6/60; D01F 6/62;
(Continued)

(56) References Cited

U.S. PATENT DOCUMENTS

2004/0244863 A1* 12/2004 Keller ..... D04B 21/04 139/391
2006/0037154 A1* 2/2006 Goineau ..... D02G 1/00 8/478
2017/0073858 A1* 3/2017 Goenka ..... D03D 15/04

FOREIGN PATENT DOCUMENTS

CN 203 947 250 U 11/2014
GB 1 366 390 A 9/1974

OTHER PUBLICATIONS

International Search Report and Written Opinion dated May 4, 2017.

* cited by examiner

*Primary Examiner* — Leo B Tentoni
(74) *Attorney, Agent, or Firm* — Fresh IP PLC; Clifford D. Hyra; Aubrey Y. Chen

(57) ABSTRACT

A method for producing a textile product (I), (II), comprising at least two synthetic pile threads (P1), (P2) having a different pile height, so that a predetermined design is formed, in which the synthetic pile yarns (P1), (P2) are manufactured by extrusion from the same raw material, according to production processes which only differ from each other by a different setting of one or several process parameters of their respective extrusion processes, so that they have a different shrinking capability, and in which the textile product (I), (II) is subjected to a heat treatment which causes the pile yarns (P1), (P2) to shrink differently. Also such a method for producing synthetic textile yarns (P1), (P2) having a different shrinking capability.

5 Claims, 2 Drawing Sheets

(51) Int. Cl.

| | |
|---|---|
| ***D01D 7/00*** | (2006.01) |
| ***D01D 10/02*** | (2006.01) |
| ***D01F 6/06*** | (2006.01) |
| ***D01F 6/60*** | (2006.01) |
| ***D01F 6/62*** | (2006.01) |
| ***D02G 1/00*** | (2006.01) |
| ***D02J 1/12*** | (2006.01) |
| ***D02J 13/00*** | (2006.01) |
| ***D03D 15/04*** | (2006.01) |
| ***D03D 27/06*** | (2006.01) |
| ***D04B 1/02*** | (2006.01) |
| ***D04B 1/04*** | (2006.01) |
| ***D04B 21/02*** | (2006.01) |
| ***D04B 21/04*** | (2006.01) |
| ***D05C 15/36*** | (2006.01) |
| ***D03D 15/567*** | (2021.01) |
| ***D03D 27/00*** | (2006.01) |
| ***D05C 15/34*** | (2006.01) |
| ***D05C 17/02*** | (2006.01) |
| ***D02G 3/44*** | (2006.01) |

(52) U.S. Cl.

CPC ..... *D05C 15/34* (2013.01); *D05C 17/026* (2013.01); *D05D 2305/26* (2013.01); *D10B 2503/04* (2013.01)

(58) Field of Classification Search

CPC ..... D02G 1/00; D02G 1/004; D02G 3/445; D02J 1/12; D02J 13/00; D03D 15/0033; D03D 15/04; D03D 27/00; D03D 27/06; D03D 2700/60; D04B 1/02; D04B 1/04; D04B 21/02; D04B 21/04; D05C 15/34; D05C 15/36; D05C 17/026; D10B 2503/04

USPC ..... 264/103, 168, 210.2, 210.8, 211.12, 264/211.14, 211.15, 211.17, 331.17, 264/331.19, 331.21; 28/160, 247

See application file for complete search history.

METHOD FOR PRODUCING A TEXTILE PRODUCT

This application is a National Phase entry of International Application No. PCT/IB2017/050183 under § 371 and claims the benefit of Belgian patent application No. BE2016/0010, filed Jan. 15, 2016, which is hereby incorporated by reference in its entirety.

FIELD OF THE INVENTION

The present disclosure relates to, on the one hand, a method for producing a textile product, in particular a woven or a tufted carpet, comprising first and second pile threads made from a synthetic material and having a mutually different pile height so that the pile threads form a predetermined design or a predetermined pattern due to their different pile height, as well as a textile product produced according to this method.

On the other hand, the present disclosure also relates to a method for manufacturing textile yarns made from synthetic material which are suitable to be used as pile yarn when using the method mentioned in the previous paragraph, and the textile yarns manufactured according to this method.

BACKGROUND

Synthetic yarns which are suitable for producing carpets are, for example, BCF yarns (BCF=bulked continuous filament) or crimped yarns. Synthetic textile yarns are usually manufactured by means of an extrusion process. In this case, separate filaments are made from a thermoplastic, such as e.g. polypropylene or polyester or a polyamide, such as for example polyamide 6. A number of the filaments produced in this way are combined to form a bundle of filaments to form a so-called multifilament yarn.

During the texturing process, the yarn may be drawn. In order to make the yarn more voluminous, such a yarn may be textured. This is carried out for the first time, for example, in the extrusion line during winding up of the yarn.

It is also possible to combine and twist several bundles of filaments and then subject them to a heat treatment ('heat-set') to set the yarn. The yarns may be dyed during or after formation. The extrusion process together with all the treatments to which the yarn is subjected during or after the extrusion before the yarn is combined with other yarns to form a textile product, is referred to in this patent application by the term production process.

In order to render the appearance of a textile product comprising pile threads more varied and more attractive from an aesthetic point of view, it is possible to provide pile threads having two or more different pile heights according to a predetermined design or pattern. Thus, it is for example possible to form zones having a mutually different pile height in the textile product.

A known method, described in Belgian patent BE1019155, involves a first and a second set of pile warp threads having a mutually different tension being supplied during weaving. As a result thereof, the elongation of these pile warp threads differs. After the double-face fabric has been cut, the yarns end up in a tensionless state and the elastic deformation of the yarn ceases. Since the pile warp threads have a mutually different elongation, their ultimate pile height with respect to each other also differs. This method requires an adjustment of the weaving machine in order to be able to supply pile yarns having two different tensions.

According to another known method, a carpet is provided with pile yarns from shrink acrylic, a yarn having a relatively large shrinking capability, in combination with pile yarns which have a smaller shrink factor. By subjecting the pile yarns of different shrinking capability to a treatment whereby they shrink, they end up having a different length, resulting in different pile heights. However, shrink acrylic is an expensive material. This yarn cannot be produced by extrusion and requires a specific production process. Producers of textile products who have their own extrusion line cannot manufacture the shrink acrylic themselves and consequently have to buy it.

SUMMARY

It is an object of embodiments of the present invention to provide a method for manufacturing a textile product comprising first and second pile threads made from a synthetic material and having a mutually different pile height, so that the pile threads form a predetermined design or a predetermined pattern due to their different pile height, using pile yarns which can be produced from relatively inexpensive raw materials according to a simple method, preferably in the same installation(s).

This provides the possibility of freely selecting the design of the fabric across the entire surface of the fabric, with variation also being possible in the warp direction, and in which the design can freely be determined after configuration of the weaving machine, for example by means of a jacquard device.

This object may be achieved by using, with such a method, first and second synthetic textile yarns, which are manufactured by extrusion from the same raw material, for pile forming, in which the first and second textile yarns are manufactured by extrusion processes which only differ from each other by a different setting of one or several process parameters of their respective extrusion processes, so that the first and the second textile yarns have a different shrinking capability, in which the first and second textile yarns form pile in order, to produce in their shrunk state the desired pile height at the desired locations in accordance with the predetermined design or pattern, and in which the textile product is subjected to a heat treatment which causes the first and second textile yarns to shrink differently.

Said object may also be achieved by providing a method for manufacturing textile yarns from synthetic material which are suitable to be used as pile yarn, in which first and second textile yarns are manufactured by extrusion from the same raw material, and are optionally subjected to an after-treatment (e.g. thermal stabilisation, optionally in combination with twisting), according to production processes which only differ from each other by a different setting of one or several process parameters of their respective extrusion processes, so that the first and the second textile yarns have a different shrinking capability. The first and second textile yarns produced in this way are obviously very suitable to be used as pile yarn in the production of a textile product using pile yarns having a different pile height.

A set of synthetic textile yarns for manufacturing a textile product comprising a first and second textile yarn manufactured according to this method and with a different shrinking capability is also a subject of embodiments of the present invention. In particular, this involves a set of textile yarns which are provided for manufacturing the same textile product.

With the method for manufacturing textile yarns according to embodiments of the present invention and with the method for producing a textile product according to embodiments of the present invention, the first and second textile yarns are preferably manufactured from the same raw material according to extrusion processes which differ from each other by a different setting of one or several process parameters of their respective extrusion processes, whereas the process components are the same in these extrusion processes. Process components are components of the extrusion line which determine the characteristics of the yarn.

The synthetic textile yarns according to embodiments of the present invention may be used with a method for producing textile products comprising raised pile threads, pile loops, thread ends or filaments, irrespective of their production method. As mentioned above, this may be woven or tufted carpets, but also, for example, velvet fabrics. Textile yarns having a different shrinking capability may also be used in knitted fabrics so as to be able to produce a predetermined effect afterwards by means of an after-treatment.

Changing process parameters not only reduces the length of the yarn, but also changes other properties which determine the appearance. Thus, the yarn may also become less voluminous (and therefore also thinner) by reducing the crimping. The shade of the colour may also change due to the yarn becoming less voluminous. In a less voluminous yarn, the filaments are packed more tightly; the textile yarn is less airy. These additional effects of shrinking will also differ with textile yarns having a different shrinking capability and thus result in a different appearance of the shrunk textile yarn which further increases the variation in the textile product. The mutual differences between these appearance-determining characteristics may also be used to make a predetermined effect or design or pattern visible. With some applications, these differences may be more important than the pile height differences.

Preferably, the textile yarns with different shrinking capability are provided with a distinguishing mark or wound onto a winding-up body having a different appearance or distinguishable in another way, so that it is possible to make a distinction between textile yarns of different shrinking capability, even if they are the same colour.

The textile yarns with different shrinking capability may also have a different colour.

Production of the synthetic textile yarns with different shrinking capability according to embodiments of the present invention can be achieved in a simple manner. After the first textile yarn has been produced, the same production process may be used to produce the second textile yarn, that is to say after the setting of one or several process parameters of the extrusion process of the yarn has been changed. An after-treatment process may follow, for example on a heat-setting line. Another after-treatment is, for example, an additional texturing process to produce a voluminous yarn followed by a cooling process to set the yarn.

The yarns with different shrinking capability can thus be produced one immediately after the other using the same extrusion line. Preferably, these successive extrusion processes only differ by the fact that one or several of their process parameters are different. If required, some small mechanical modifications may also be necessary thereto, but in this case, the process components are not replaced by others. This makes producing yarns of different shrinking capability very simple and inexpensive. The same extrusion line with the same arrangement (e.g. arrangement of the spinning plates) can be used. It suffices to change one process parameter (or a number of process parameters). Virtually no mechanical modifications are necessary. Also, the components of the extrusion line do not have to be cleaned between both production processes, since the same raw material is being used and the yarns produced preferably also have the same colour.

The parameters which may be changed, for example, to influence the shrinking capability include the temperature, the air flow rate, the speed, the draw parameters, etc.

In a preferred method according to some embodiments of the present invention, the temperature to which the yarn is exposed just before or inside the texturing unit is adapted to achieve a different shrinking capability.

It is also possible to achieve a different shrinking capability by changing the speed of the draw roll just before the texturing unit. This change in the speed of the draw roll may be combined with a change in the temperature to which the yarn is exposed just before or inside the texturing unit.

More specificially, it is also possible to change one or several of the following parameters:

- the temperatures of the one or several pairs of draw rolls just before the texturing unit;
- the speed of the one or several pairs of draw rolls just before the texturing unit (thinner incoming yarn versus thicker yarn);
- the temperature of the hot air which is blown into the texturing unit;
- the speed of the winder (where the extruded yarn is wound onto winding-up bodies).

Due to the different process parameter(s) of the extrusion process, it is important that a temperature treatment is performed, preferably a cooling, in order to "set" the yarn differences which resulted during production and which produce a different shrinking capability.

The shrinking properties are measured in accordance with DIN 53840.

During production of the textile product on a textile machine, such as a weaving machine or a tufting device, the textile machine may function, for example, in a way which results in a textile product without pile height differences. The pile height differences are only realized after the textile product has undergone a heat treatment which makes the textile yarns shrink. No modifications of the textile machine are required. A machine which is already configured to produce certain pile height differences may continue to function in this way, but by different shrinking the textile yarns used according to some embodiments of the present invention, it is possible to produce additional pile height differences or more pronounced pile height differences without adjusting the machine.

Thus, it becomes possible, in a textile product with raised pile threads from the same raw material, such as a woven or a tufted carpet, which has been produced in such a way that there is no relief or only a limited relief because of the pile height, to produce a relief after all or to produce a more pronounced relief, respectively, by creating pile height differences during an after-treatment in accordance with a predetermined design or pattern. Thus, it is also possible to increase the number of different pile heights or make them more pronounced in a textile product which is produced using a certain number of pile threads with different pile heights.

In this way, a textile product can be produced in a simple and inexpensive manner using pile threads which have a different pile height (at least two different pile heights) and thus render a predetermined figure or pattern visible.

As a result of the pile height differences, it is possible to create a shadow effect. This is mainly the case if the carpet comprises pile threads of one single colour, due to the different pile heights. In the single-coloured pile zones, a subtle design or pattern is achieved which resembles a shadow effect which is produced by the slanting orientation of the pile legs. The shadow effect which is produced according to some embodiments of the present invention differs from the latter by the fact that the pile legs are always upright and that the effect does not depend on the viewing angle.

The textile yarns according to some embodiments of the present invention may be used, inter alia, in the production of tufted carpets. In this way, more pile height differences can be introduced than the machine can manage.

If, for example, a machine is configured to provide a uniform pile delivery across the entire width of the carpet (i.e. without pile height differences), it is still possible, according to some embodiments of the invention, to achieve a pile height difference in the tufted carpet.

Thus, yarn of the same colour may be provided in two or more versions with mutually different shrink factor (e.g. white high, white low, blue high, blue low).

The yarns may be provided with a colour beforehand (i.e. during the production process of the yarn). If the textile yarns are made from polyester or polyamide, they may also be dyed afterwards (i.e. after the yarn and/or the carpet has been produced).

Some embodiments of the invention may be used in the production of a pile fabric on a weaving machine. This may be, for example, a double-face weaving method in which two base fabrics are simultaneously woven one above the other from ground warp threads and weft threads, optionally with additional tension warp threads, and in which pile is formed selectively by interlacing the desired pile warp threads—in accordance with a predetermined design or pattern—alternately in the upper and the lower base fabric over one or several weft threads, and in which the pile warp threads extending between the base fabrics are subsequently cut to ultimately produce two pile fabrics.

With such a method, the selective pile forming is usually carried out by means of a jacquard device with which the separate pile warp threads are suitably positioned in each weaving cycle with respect to each level at which a weft thread is inserted. When using the method according to some embodiments of the present invention, it is thus possible to use pile warp threads with a different shrinking capability which cannot be externally distinguished, but in which these are allowed to form pile, taking into account the different pile height which they will eventually have due to their different shrinking capability, in such a way that the desired design or pattern is formed by means of these eventual pile height differences.

By providing pile warp threads with different shrinking capability in the fabric at every location where pile formation is desired, viewed across the width of the weaving machine, and by allowing the pile warp threads with different shrinking capability to form pile between the two base fabrics according to the desired pattern or, alternatively, by allowing the pile warp threads to run along in the associated base fabric, it is possible to create pile fabrics which may have height differences at each desired pile forming position corresponding to the different shrinking capability of the yarns used.

Especially when the yarns are hardly distinguishable, if at all, by their appearance after extrusion, it is important to be able to identify the yarns. The different yarns may, for example, be distinguished from one another by winding them onto a winding-up body having a different appearance, for example a different colour.

However, the pile warp threads with different shrinking capability may show one or more external differences in the non-shrunk state. They may, for example, have a different colour.

Preferably, the yarns with different shrinking capability have the same or very similar yarn characteristics. Thus, the number of filaments per thread is preferably identical.

As already mentioned, the shrinkage which the yarn undergoes when applying a heat treatment after the production process of the yarn, denoted as 'residual shrinkage', differs from one textile yarn with respect to the other due to the modified process parameters during its production. Ultimately, the entire textile product will be subjected to a heat treatment, during which this different shrinking capability manifests and results in pile threads having a different pile height. This heat treatment may have the sole objective of shrinking the yarns, but may also be a treatment which has another objective and which is a standard after-treatment process for finishing the textile product, such as for example the application of a plastic layer on the backing of the product.

A heat treatment comprises, for example, placing the textile product in an oven at a temperature of 120° for 10 minutes. In other circumstances, heating the textile product to a temperature between 80° and 130° for 5 to 30 minutes may suffice. Heating the textile product in a steam oven is another possibility. Obviously, the temperatures have to be lower than the melting points of the materials used.

An exemplary embodiment is given below to indicate how a modified shrinking capability may be achieved when producing a crimped polypropylene textile yarn.

To this end, the normal temperature of the draw rolls before texturing is changed, just like the temperature of the hot air which is blown into the texturing unit. All other parameters remained unchanged.

The installation used for extrusion comprises two pairs of draw rolls before texturing which can be heated. The textile yarn is extruded from polypropylene according to a method which is known in the art.

Subsequently, a texturing process is used to produce a crimped yarn, in which case a crimping of 19% is achieved, which is a common amount of crimping for a BCF carpet yarn.

In this case, the set parameters are as follows:

Temperature of the first pair of heated draw rolls: 92° C.

Temperature of the second pair of heated draw rolls: 130° C.

Temperature of the hot air in the texturing unit: 152° C.

Thereafter, certain parameters of the texturing process are changed, so that a crimping of 10% is achieved. The changed parameters are:

Temperature of the first pair of heated draw rolls: 100° C.

Temperature of the second pair of heated draw rolls: 115° C.

Temperature of the hot air in the texturing unit: between 120° C. and 155° C. (152° C. to 153° C. is the normal temperature), preferably between 125° C. and 140° C., preferably 130° C.

Other parameters which, if modified, might also result in a different shrinking capability are, for example, the amount of hot air or the pressure of the hot air and also the speeds of the rolls.

Other values (such as the temperature of the extruders themselves or the number of resulting filaments, etc.) are not modified, for example.

It is important that the temperature remains in the range between the glass transition temperature and the melting point (the softening and melting point) of the polymer, preferably sufficiently far from the limits.

In order to produce a lower shrinking capability for polyamide textile yarns, the temperature of the hot air in the texturing unit may be between 130° C. and 180° C. (175° C. is the normal temperature), preferably between 140° C. and 160° C., preferably 150° C.

In order to produce polyester textile yarns with a lower shrinking capability, the temperature of the hot air in the texturing unit may be between 125° C. and 175° C. (170° C. is the normal temperature), preferably between 135° C. and 155° C., preferably 140° C.

The temperature of the draw rolls is adapted in such a way that the yarn material runs as smoothly as possible into the texturing unit. With polyester, for example, there is only a minimal temperature difference between the hot air in the texturing unit and the second pair of heated draw rolls.

BRIEF DESCRIPTION OF THE DRAWINGS

The method according to some embodiments of the invention is illustrated in the attached figures, in which.

DETAILED DESCRIPTION

Figure 1:
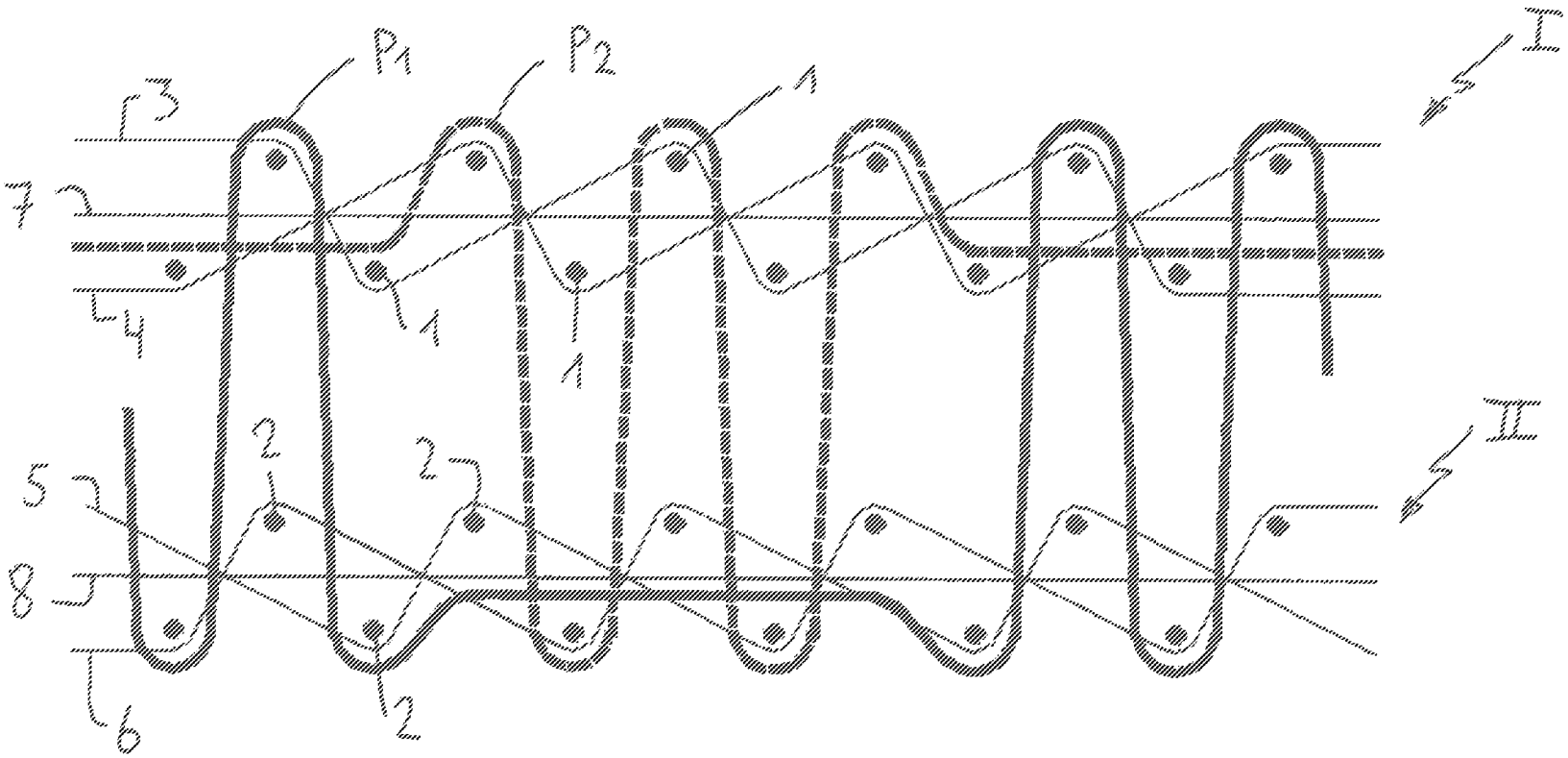
FIG. 1 is a diagrammatic cross section of a portion of a double-face carpet while it is being woven on a double-face weaving machine.

With double-face weaving, two base fabrics (I), (II) are simultaneously woven one above the other (see FIG. 1) using weft threads and warp threads of successive warp thread systems. In the figures, the warp threads of one warp thread system are shown.

Using weft threads (1), binding warp threads (3, 4) and tension warp threads (7), an upper base fabric (I) is woven. Using weft threads (2), binding warp threads (5, 6) and tension warp threads (8), a lower base fabric (II) is woven.

Each warp thread system also comprises two pile warp threads (P1), (P2) made of textile yarn with a different shrinking capability, which—in accordance with a desired design achieved by pile height differences—is either allowed to form pile by alternately interlacing it over a weft thread (1) of the upper fabric (I) and a weft thread (2) of the lower fabric (II) or not allowed to form pile and interlaces in one of the base fabrics (I), (II) while running along in an extended way with the tensioning warp thread (7), (8).

In every weft insertion cycle, the pile warp threads (P1), (P2) are to this end positioned with respect to the two levels at which a weft thread (1), (2) is simultaneously inserted.

By cutting the pile warp threads (P1), (P2) running between the base fabrics, the two fabrics are separated from each other and two separate pile fabrics (I), (II) are obtained. At that moment, there is no pile height difference in these pile fabrics. The pile legs produced using the different pile warp yarns (P1), (P2) are still identical.

Figure 2:
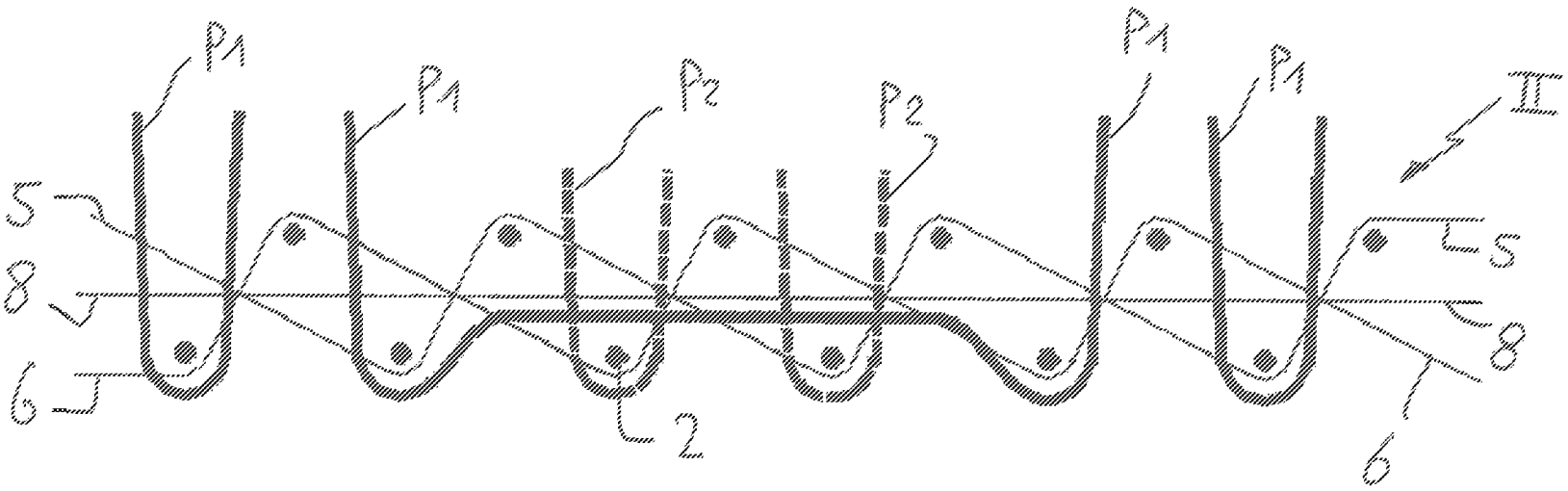
FIG. 2 shows a diagrammatic cross section of a portion of one of the carpets from FIG. 1, after cutting of the pile warp threads, and after application of a heat treatment which makes the textile yarns used as pile yarn shrink differently.

It is only after the pile fabrics (I), (II) have undergone a heat treatment that the pile legs made using the different textile yarns (P1), (P2) have a different length and thus form a respective zone having a different pile height, as can be seen in FIG. 2.

The invention claimed is:

1. Method for producing a textile product comprising first and second pile threads made from a synthetic material and having a mutually different pile height so that the pile threads form a predetermined design or a predetermined pattern due to their different pile height, comprising:

manufacturing first and second synthetic textile yarns by extrusion from the same raw material in the same texturing unit, using the same extrusion line comprising the same process components, and using the first and second synthetic textile yarns for pile forming, wherein the manufacturing of the first and second synthetic textile yarns by extrusion comprises using extrusion processes for each of the first and second synthetic textile yarns which only differ from each other by a different setting of one or several process parameters of their respective extrusion processes, so that the first and the second textile yarns have a different shrinking capability, wherein using the first and second textile yarns to form pile is done in order to produce in the shrunk state the desired pile height at the desired locations in accordance with the predetermined design or pattern, and further comprising subjecting the textile product to a heat treatment which causes the first and second textile yarns to shrink differently.

2. Method for producing a textile product according to claim 1, further comprising manufacturing a third synthetic textile yarn by extrusion from the same raw material in the same texturing unit, using the same extrusion line comprising the same process components, and using the third synthetic textile yarn for pile forming, and wherein extrusion of the third synthetic textile yarn comprises an extrusion process which only differs from the extrusion processes for the first and second synthetic textile yarns by a different setting of one or several process parameters, so that the first, second and third synthetic textile yarns have a mutually different shrinking capability, and wherein the first, second and third synthetic textile yarns are used to form pile so that, in the shrunk state, they produce the desired pile height in accordance with the predetermined design or pattern at the desired locations, and wherein subjecting the textile product to a heat treatment causes the different textile yarns to shrink differently so that at least three different pile heights are produced.

3. Method for producing a textile product according to claim 1, characterized in that the textile yarns are manufactured in the same texturing unit, in which at least one pair of draw rolls is provided before the texturing unit, and in which a winder is provided for winding up the extruded yarns, and in that said extrusion processes differ from each other by a modified setting of:

one or several process parameters of the texturing unit, and/or the temperature of at least one pair of draw rolls, and/or the speed of at least one pair of draw rolls, and/or the speed of the winder.

4. Method for producing a textile product according to claim 1, characterized in that the synthetic textile yarns are manufactured from polypropylene, polyester or polyamide.

5. Method for producing a textile product according to claim 1, characterized in that the synthetic textile yarns have a different colour as well as a different shrinking capability.

* * * * *